US012758056B2

(12) United States Patent
Craft et al.

(10) Patent No.: US 12,758,056 B2
(45) Date of Patent: Oct. 13, 2026

(54) CURTAIN EXTENDER DEVICE

(71) Applicants: Beverly Craft, Lakeland, FL (US); Bruce Craft, Lakeland, FL (US)

(72) Inventors: Beverly Craft, Lakeland, FL (US); Bruce Craft, Lakeland, FL (US)

( * ) Notice: Subject to any disclaimer, the term of this patent is extended or adjusted under 35 U.S.C. 154(b) by 98 days.

(21) Appl. No.: 18/769,570

(22) Filed: Jul. 11, 2024

(65) Prior Publication Data

US 2025/0098907 A1 Mar. 27, 2025

Related U.S. Application Data

(60) Provisional application No. 63/584,964, filed on Sep. 25, 2023.

(51) Int. Cl.
*A47K 3/38* (2006.01)

(52) U.S. Cl.
CPC ..... *A47K 3/38* (2013.01)

(58) Field of Classification Search
CPC ..... A47K 3/38
See application file for complete search history.

(56) References Cited

U.S. PATENT DOCUMENTS

| | | | | |
|---|---|---|---|---|
| 3,382,507 | A | 5/1968 | Micheau | |
| 5,111,868 | A | 5/1992 | Sawaya | |
| 5,191,922 | A * | 3/1993 | Wade | A47H 23/04 160/124 |
| 7,987,534 | B2 | 8/2011 | Lin | |
| 10,206,543 | B2 | 2/2019 | Maner | |
| 11,278,145 | B2 * | 3/2022 | Ma | A47H 23/04 |
| 2008/0115265 | A1 | 5/2008 | Heaslip | |
| 2008/0201839 | A1 | 8/2008 | Dalton | |
| 2009/0272502 | A1 * | 11/2009 | Brown | A47K 3/38 24/591.1 |
| 2020/0163482 | A1 * | 5/2020 | Ma | B32B 3/06 |

* cited by examiner

*Primary Examiner* — Janie M Loeppke
(74) *Attorney, Agent, or Firm* — Brennan, Manna & Diamond, LLC

(57) ABSTRACT

A shower curtain extender device is disclosed that lengthens a standard shower curtain. The shower curtain extender device comprises a body component that is configured in a rectangular shape that measures approximately seventy inches wide by ten inches long and has a variable thickness. The body component comprises a row of buttonholes spaced every six inches along the top and a corresponding row of buttons placed along the bottom directly beneath each buttonhole. To make the device more adjustable a second row of buttons could be positioned 1-2 inches above the bottom row of buttons.

13 Claims, 3 Drawing Sheets

CURTAIN EXTENDER DEVICE

CROSS-REFERENCE TO RELATED APPLICATION

The present application claims priority to, and the benefit of, U.S. Provisional Application No. 63/584,964, which was filed on Sep. 25, 2023, and is incorporated herein by reference in its entirety.

FIELD OF THE INVENTION

The present invention relates generally to the field of shower curtain extender devices. More specifically, the present invention relates to a device for lengthening a standard shower curtain approximately 8-9 inches. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in shower curtain extender devices. Generally, standard shower curtains may be too short allowing water to leave the shower area. Further, water escaping around the edges of the shower and tub can cause damage to the floor and walls, possibly leaving behind mold and mildew. However, constantly drying and/or cleaning the area can be frustrating.

Furthermore, aesthetically a user may wish to hang a shower curtain to the floor, such that the room appears bigger. Additionally, custom shower curtains are expensive to purchase and/or make. A means to extend existing shower curtains is needed, such that the shower area is protected from escaping water and users need not constantly have to dry the area.

Accordingly, there is a demand for an improved shower curtain extender device that lengthens a standard shower curtain. More particularly, there is a demand for a shower curtain extender device that prevents water from splashing out of the bathtub and causing damage to the floor and wall areas near the bathtub.

Therefore, there exists a long-felt need in the art for a shower curtain extender device that provides users with a device for lengthening a standard shower curtain approximately 8-9 inches. There is also a long-felt need in the art for a shower curtain extender device that features a top row of buttonholes to be attached to the shower curtain rings. Further, there is a long-felt need in the art for a shower curtain extender device that features a bottom row of buttons to be attached to the top of the shower curtain. Moreover, there is a long-felt need in the art for a device that can include an optional decorative topper to conceal the device and improve its appearance. Further, there is a long-felt need in the art for a shower curtain extender device wherein the optional decorative topper utilizes a wide pocket to accommodate a curtain tension rod. Finally, there is a long-felt need in the art for a shower curtain extended device that prevents water from splashing out of the bathtub and causing damage to the floor and wall areas near the bathtub.

The subject matter disclosed and claimed herein, in one embodiment thereof, comprises a shower curtain extender device. The device lengthens a standard shower curtain. The shower curtain extender device comprises a body component that is configured in a rectangular shape that measures approximately seventy inches wide by ten inches long and has a variable thickness. The body component comprises a row of buttonholes spaced every six inches along the top and a corresponding row of buttons placed along the bottom directly beneath each buttonhole. To make the device more adjustable a second row of buttons could be positioned 1-2 inches above the bottom row of buttons.

In use, the device's bottom row of buttons are attached to the top row of the buttonholes, and the device's top row of buttonholes are attached to the shower curtain rings before being hung. Furthermore, the device may also offer different color valence topper components to conceal the device. The valence topper component also comprises a wide pocket to accommodate a tension rod for positioning in front of the device. The device is available in several colors, lengths, and styles.

In this manner, the shower curtain extender device of the present invention accomplishes all of the foregoing objectives and provides users with a device that lengthens a standard shower curtain. The device comprises a valence topper component to conceal the extension part of the device. The device is available in several colors, lengths, and styles.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a shower curtain extender device. The device lengthens a standard shower curtain. The shower curtain extender device comprises a body component that is configured in a rectangular shape. The body component comprises a row of buttonholes spaced apart along the top and a corresponding row of buttons placed along the bottom directly beneath each buttonhole. The body component is secured to the shower curtain via the rows of buttonholes and buttons to extend the shower curtain during use and prevent water from escaping the shower/bath area and causing damage to the floor and walls.

In one embodiment, the shower curtain extender device is similar in appearance to a traditional shower curtain and is manufactured of lightweight vinyl, plastic, or a comparable synthetic material. The shower curtain extender device comprises a body component that is configured in a rectangular shape. In use, the body component is typically an elongated flap panel which runs the length of the top of a standard shower curtain. Typically, the body component measures approximately seventy inches wide by ten inches long and has a variable thickness but can be any suitable width and length as is known in the art. Thus, generally rectangular in shape, this unique shower curtain extender device is sized appropriately to accommodate any bathtub and/or shower stall. The device also can be produced in sizes appropriate for single, free standing shower stalls.

In one embodiment, the body component comprises a front surface, a rear surface, opposing side edges, a top edge, and a bottom edge. Further, the body component comprises a plurality of buttonholes arranged in a row and spaced apart approximately every six inches along the top edge. The buttonholes are typically a series of circular shaped openings or through-holes along the top edge for use in applying hanging shower hooks or other suitable hanging components as is known in the art. The buttonholes can be any suitable shape and size as is known in the art, as long as the buttonholes are able to accept a standard hanging shower hook.

In one embodiment, the body component comprises a plurality of buttons or other suitable fasteners as is known in the art. Specifically, the corresponding row of buttons is positioned along the bottom edge of the body component, directly beneath each buttonhole. Any suitable fastener can be utilized as is known in the art, as long as the fasteners are sized and shaped to fit within corresponding openings on a standard shower curtain to be secured.

In one embodiment, the body component comprises a second row of buttons, which are positioned 1-2 inches above the bottom row of buttons. This allows the device to be more adjustable and allows a shower curtain to be positioned lower or higher depending on the needs and/or wants of a user.

In one embodiment, the shower curtain extender device comprises a valence topper component which acts to conceal the body component during use. Specifically, the valence topper component comprises an elongated flap panel which runs the length of the top of a standard shower curtain. Typically, the valence topper component comprises a wide pocket to accommodate a tension rod for positioning the valence topper component in front of the body component. The wide pocket is positioned across the top of the valence topper component and receives the tension rod to hang the valence topper component in front of the body component and shower curtain, concealing the body component from view. In another embodiment, the valence topper component can be secured in front of the body component via any suitable means as is known in the art. Further, the valence topper component would be available in different colors and styles.

In one embodiment, the shower curtain extender device is produced in a myriad of attractive colors to correspond with existing bathroom decor, as well as in various neutral hues. Thus, the shower curtain extender device is available in several colors, lengths, and styles.

In use, the shower curtain extender device's bottom row of buttons are secured to the top row of circular holes of a standard shower curtain, and the device's top row of buttonholes are attached to the shower curtain rings. Once secure, the device and attached shower curtain is hung on a shower rod, which allows the shower curtain to be lengthened approximately 8-9 inches.

In yet another embodiment, the shower curtain extender device comprises a plurality of indicia.

In yet another embodiment, a method of extending the length of a standard shower curtain is disclosed. The method includes the steps of providing a shower curtain extender device comprising a body component with a plurality of buttonholes and buttons. The method also comprises inserting shower curtain rings into the plurality of buttonholes of the device. Further, the method comprises securing the plurality of buttons to the through holes of the shower curtain. Finally, the method comprises securing a valence topper component to a top of the device to hide the device.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
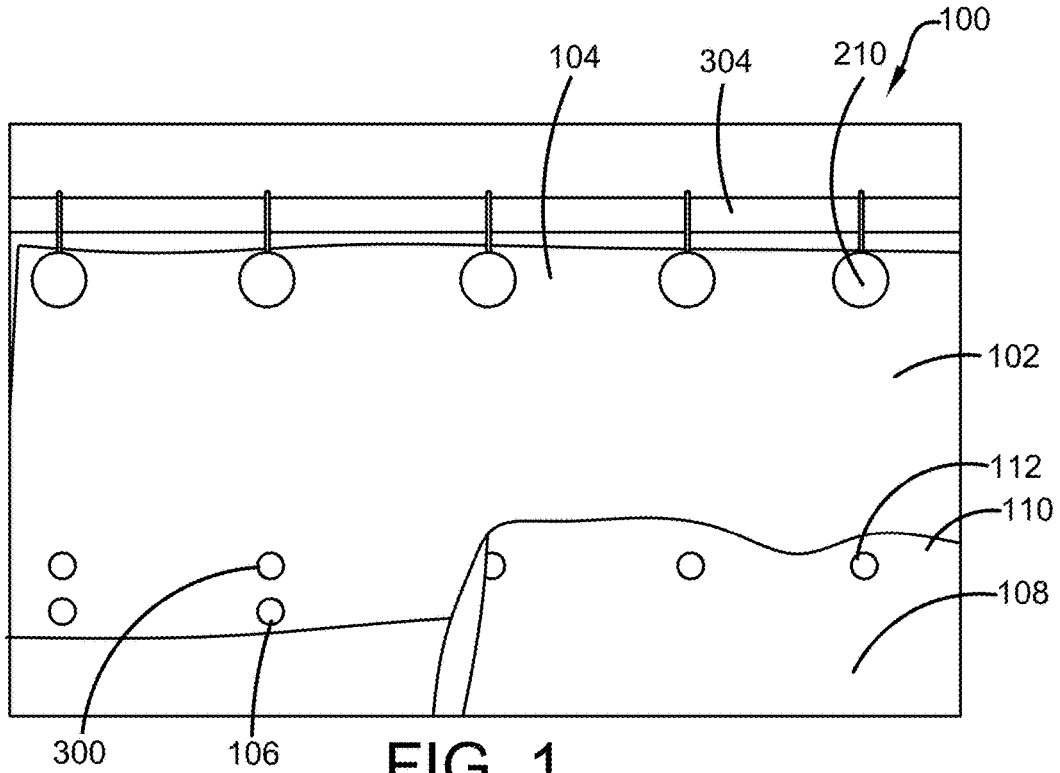
FIG. 1 illustrates a perspective view of one embodiment of the shower curtain extender device of the present invention showing the device applied to the shower rings of a shower rod in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a shower curtain extender device that provides users with a device for lengthening a standard shower curtain approximately 8-9 inches. There is also a long-felt need in the art for a shower curtain extender device that features a top row of buttonholes to be attached to the shower curtain rings. Further, there is a long-felt need in the art for a shower curtain extender device that features a bottom row of buttons to be attached to the top of the shower curtain. Moreover, there is a long-felt need in the art for a device that can include an optional decorative topper to conceal the device and improve its appearance. Further, there is a long-felt need in the art for a shower curtain extender device wherein the optional decorative topper utilizes a wide pocket to accommodate a curtain tension rod. Finally, there is a long-felt need in the art for a shower curtain extended device that prevents water from splashing out of the bathtub and causing damage to the floor and wall areas near the bathtub.

The present invention, in one exemplary embodiment, is a novel shower curtain extender device. The device lengthens a standard shower curtain. The shower curtain extender device comprises a body component that is configured in a rectangular shape that measures approximately seventy inches wide by ten inches long and has a variable thickness. The body component comprises a row of buttonholes spaced every six inches along the top and a corresponding row of buttons placed along the bottom directly beneath each buttonhole. To make the device more adjustable a second row of buttons could be positioned 1-2 inches above the bottom row of buttons. The present invention also includes a novel method of extending the length of a standard shower curtain. The method includes the steps of providing a shower curtain extender device comprising a body component with a plurality of buttonholes and buttons. The method also comprises inserting shower curtain rings into the plurality of buttonholes of the device. Further, the method comprises securing the plurality of buttons to the through holes of the shower curtain. Finally, the method comprises securing a valence topper component to a top of the device to hide the device.

Referring initially to the drawings, FIG. 1 illustrates a perspective view of one embodiment of the shower curtain extender device 100 of the present invention. In the present embodiment, the shower curtain extender device 100 is an improved shower curtain extender device 100 that provides a user with a device for lengthening a standard shower curtain 108. Specifically, the shower curtain extender device 100 comprises a body component 102 with a plurality of buttonholes 104 and a plurality of buttons 106. The body component 102 is secured to the shower curtain 108 via the rows of buttonholes 104 and buttons 106 to extend the shower curtain 108 during use and prevent water from escaping the shower/bath area and causing damage to the floor and walls.

Generally, the shower curtain extender device 100 is similar in appearance to a traditional shower curtain 108, and is manufactured of lightweight vinyl, plastic, or a comparable synthetic material, etc. The shower curtain extender device 100 comprises a body component 102 that is configured in a rectangular shape. In use, the body component 102 is typically an elongated flap panel which runs the length of the top 110 of a standard shower curtain 108. Typically, the body component 102 measures approximately seventy inches wide by ten inches long and has a variable thickness but can be any suitable width and length as is known in the art. Thus, generally rectangular in shape, this unique shower curtain extender device 100 is sized appropriately to accommodate any bathtub and/or shower stall. The device 100 also can be produced in sizes appropriate for single, free standing shower stalls.

Figure 2:
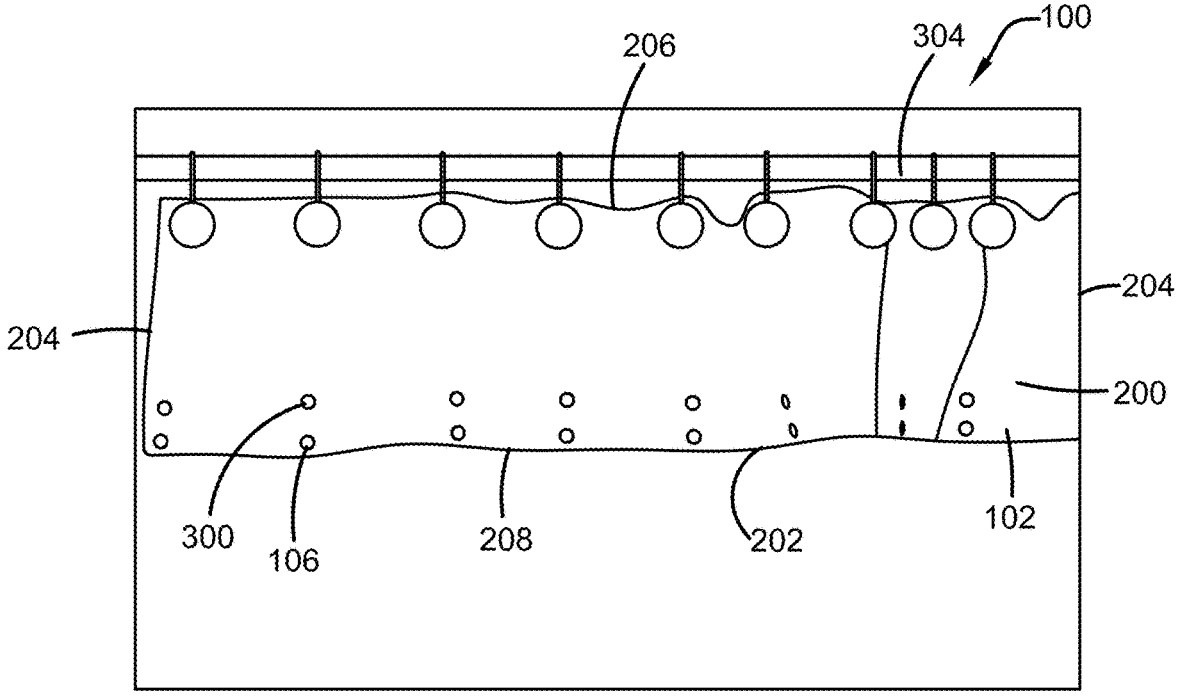
FIG. 2 illustrates a perspective view of one embodiment of the shower curtain extender device of the present invention showing the device applied to a shower curtain rod in accordance with the disclosed architecture.

As shown in FIG. 2, the body component 102 comprises a front surface 200, a rear surface 202, opposing side edges 204, a top edge 206, and a bottom edge 208. Further, the body component 102 comprises a plurality of buttonholes 104 arranged in a row and spaced apart approximately every six inches along the top edge 206. The buttonholes 104 are typically a series of circular shaped openings or through-holes along the top edge 206 for use in applying hanging shower hooks 210 or other suitable hanging components as is known in the art. The buttonholes 104 can be any suitable shape and size as is known in the art, as long as the buttonholes 104 are able to accept a standard hanging shower hook 210.

Furthermore, the body component 102 comprises a plurality of buttons 106 or other suitable fasteners as is known in the art. Specifically, the corresponding row of buttons 106 is positioned along the bottom edge 208 of the body component 102, directly beneath each buttonhole 104. Any suitable fastener can be utilized as is known in the art, as long as the fasteners are sized and shaped to fit within corresponding openings 112 on a standard shower curtain 108 to be secured.

Figure 3:
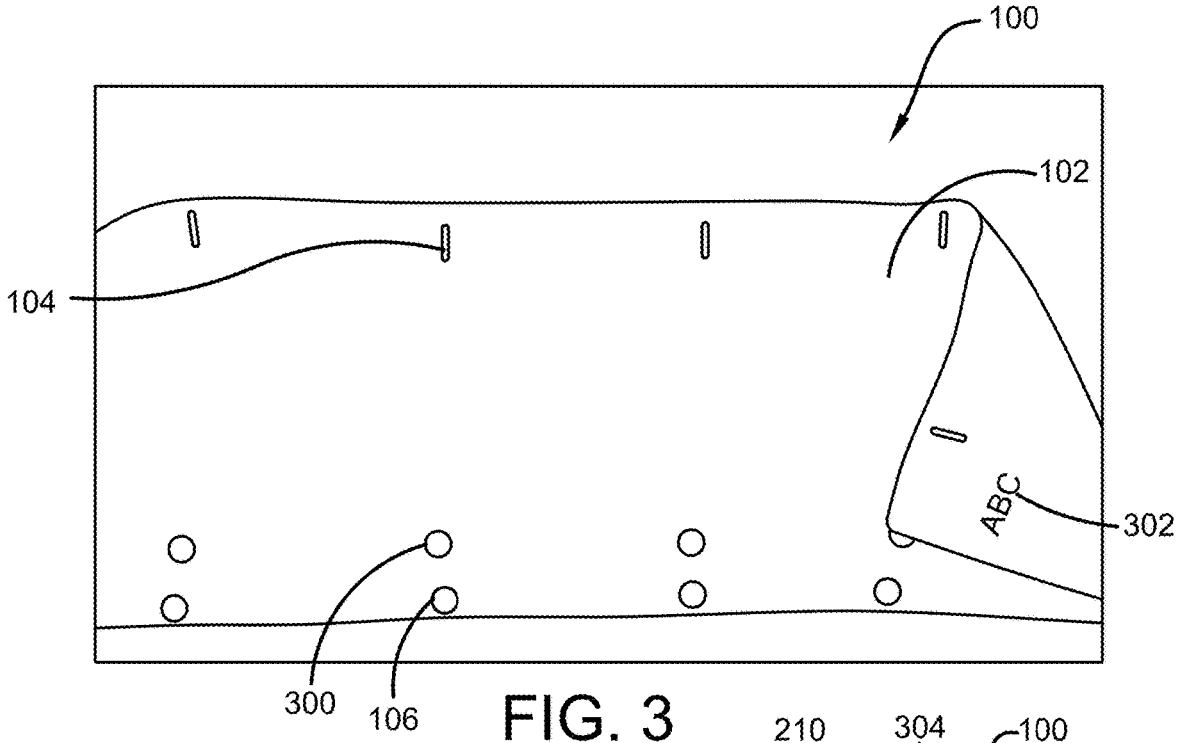
FIG. 3 illustrates a perspective view of one embodiment of the shower curtain extender device of the present invention showing the body component in accordance with the disclosed architecture.

As shown in FIG. 3, the body component 102 comprises a second row of buttons 300, which are positioned 1-2 inches above the bottom row of buttons 106. This allows the device 100 to be more adjustable and allows a shower curtain 108 to be positioned lower or higher depending on the needs and/or wants of a user.

In yet another embodiment, the shower curtain extender device 100 comprises a plurality of indicia 302. The body component 102 of the device 100 may include advertising, a trademark, or other letters, designs, or characters, printed, painted, stamped, or integrated into the body component 102, or any other indicia 302 as is known in the art. Specifically, any suitable indicia 302 as is known in the art can be included, such as, but not limited to, patterns, logos, emblems, images, symbols, designs, letters, words, characters, animals, advertisements, brands, etc., that may or may not be shower curtain, bathtub, or brand related.

Figure 4:
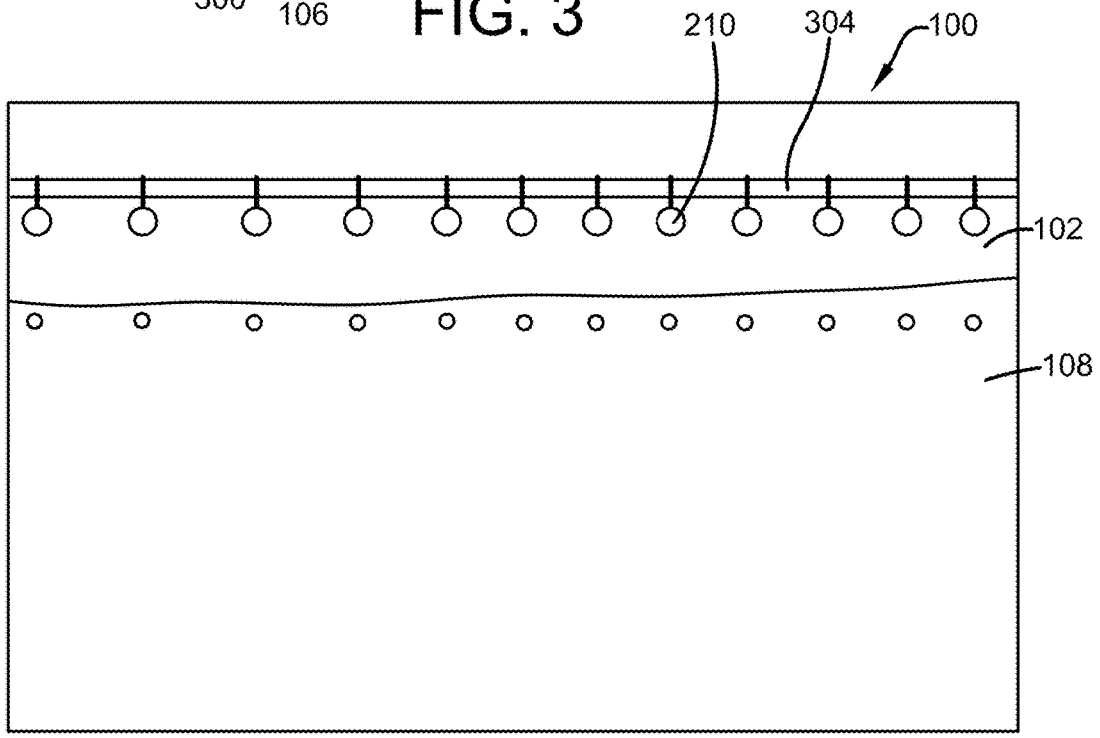
FIG. 4 illustrates a perspective view of one embodiment of the shower curtain extender device of the present invention showing the device in use in accordance with the disclosed architecture.

As shown in FIG. 4, the shower curtain extender device 100 is produced in a myriad of attractive colors to correspond with existing bathroom decor, as well as in various neutral hues. Thus, the shower curtain extender device 100 is available in several colors, lengths, and styles.

In use, the shower curtain extender device's bottom row of buttons 106 are secured to the top row of circular holes 112 of a standard shower curtain 108, and the device's top row of buttonholes 104 are attached to the shower curtain rings 210. Once secure, the device 100 and attached shower curtain 108 is hung on a shower rod 304, which allows the shower curtain 108 to be lengthened approximately 8-9 inches.

Figure 5:
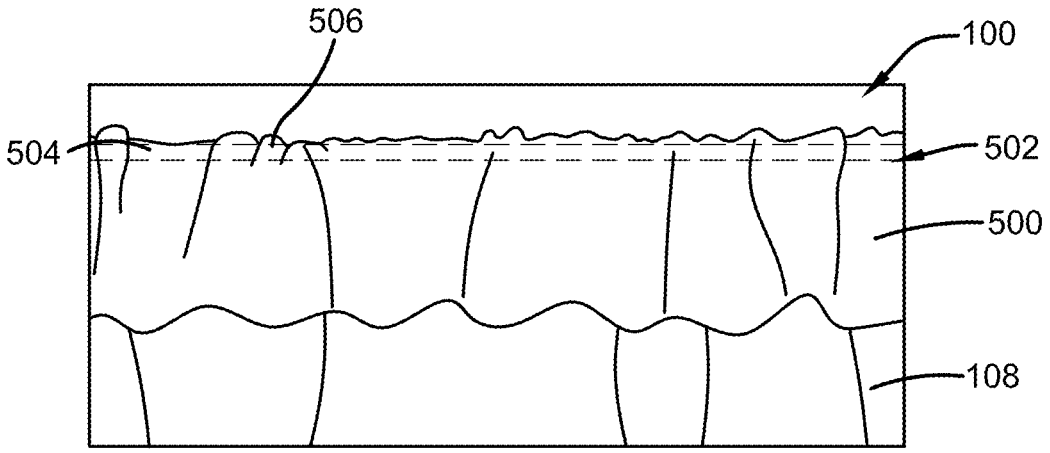
FIG. 5 illustrates a perspective view of one embodiment of the shower curtain extender device of the present invention showing the valence topper component in accordance with the disclosed architecture.

As shown in FIG. 5, the shower curtain extender device 100 comprises a valence topper component 500 which acts to conceal the body component 102 during use. Specifically, the valence topper component 500 comprises an elongated flap panel which runs the length of the top 110 of a standard shower curtain 108. Typically, the valence topper component 500 comprises a wide pocket 502 to accommodate a tension rod 504 for positioning the valence topper component 500 in front of the body component 102. The wide pocket 502 is positioned across the top 506 of the valence topper component 500 and receives the tension rod 504 to hang the valence topper component 500 in front of the body component 102 and shower curtain 108, concealing the body component 102 from view. In another embodiment, the valence topper component 500 can be secured in front of the body component 102 via any suitable means as is known in the art. Further, the valence topper component 500 would be available in different colors and styles.

Figure 6:
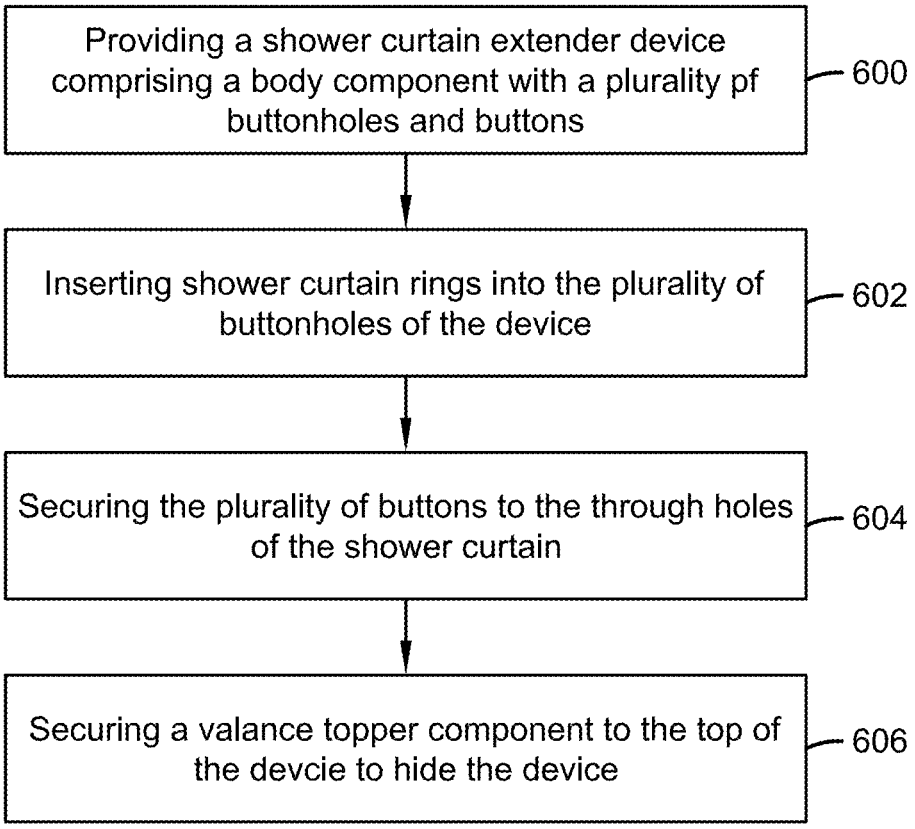
FIG. 6 illustrates a flowchart showing the method of extending the length of a standard shower curtain in accordance with the disclosed architecture.

FIG. 6 illustrates a flowchart of the method of extending the length of a standard shower curtain. The method includes the steps of at 600, providing a shower curtain extender device comprising a body component with a plurality of buttonholes and buttons. The method also comprises at 602, inserting shower curtain rings into the plurality of buttonholes of the device. Further, the method comprises at 604, securing the plurality of buttons to the through holes of the shower curtain. Finally, the method comprises at 606, securing a valence topper component to a top of the device to hide the device.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "shower curtain extender device", "shower curtain device", "extender device", and "device" are interchangeable and refer to the shower curtain extender device 100 of the present invention.

Notwithstanding the foregoing, the shower curtain extender device 100 of the present invention can be of any suitable size and configuration as is known in the art without affecting the overall concept of the invention, provided that it accomplishes the above-stated objectives. One of ordinary skill in the art will appreciate that the shower curtain extender device 100 as shown in FIGS. 1-6 is for illustrative purposes only, and that many other sizes and shapes of the shower curtain extender device 100 are well within the scope of the present disclosure. Although the dimensions of the shower curtain extender device 100 are important design parameters for user convenience, the shower curtain extender device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A shower curtain extender device that provides a device for lengthening a standard shower curtain, the shower curtain extender device comprising:

a body component;

a character indicia integrated into the body component;

a plurality of buttonholes;

a plurality of buttons; and a valence topper comprising an elongated flap; and wherein the body component is secured to a shower curtain via the plurality of buttons;

wherein the plurality of buttonholes secures the shower curtain extender device to a shower rod;

wherein the body component is a vinyl body component configured to extend the shower curtain during use and prevent water from escaping the shower and bath area;

wherein the body component is a variable thickness body; and further wherein the valance topper is secured in front of the body component to conceal the body component from view.

2. The shower curtain extender device of claim 1, wherein the body component is configured in a rectangular shape and measures approximately seventy inches wide by ten inches long.

3. The shower curtain extender device of claim 2, wherein the body component comprises a front surface, a rear surface, opposing side edges, a top edge, and a bottom edge.

4. The shower curtain extender device of claim 3, wherein the plurality of buttonholes are arranged in a row and spaced apart approximately every six inches along the top edge of the body component.

5. The shower curtain extender device of claim 4, wherein the plurality of buttonholes are a series of circular shaped openings for use in applying hanging shower hooks which are then positioned on the shower rod.

6. The shower curtain extender device of claim 5, wherein the plurality of buttons are positioned along the bottom edge of the body component, directly beneath each buttonhole.

7. The shower curtain extender device of claim 6 further comprising a second row of buttons, which are positioned 1-2 inches above a bottom row of buttons.

8. The shower curtain extender device of claim 7, wherein the shower curtain extender device is available in several colors, lengths, and styles, corresponding with existing bathroom décor.

9. The shower curtain extender device of claim 1, wherein the valence topper component comprises a wide pocket to accommodate a tension rod for positioning the valence topper component in front of the body component.

10. The shower curtain extender device of claim 9, wherein the valence topper component is available in different colors and styles to match the body component.

11. A shower curtain extender device that provides a device for lengthening a standard shower curtain, the shower curtain extender device comprising:

a body component comprising a front surface, a rear surface, opposing side edges, a top edge, and a bottom edge;

a top row of buttonholes arranged in a row and spaced apart approximately every six inches along the top edge of the body component;

a bottom row of buttons positioned along the bottom edge of the body component, directly beneath each buttonhole; and a valence topper; and wherein the bottom row of buttons are secured to a top row of circular holes of a standard shower curtain;

wherein the top row of buttonholes are attached to shower curtain rings;

wherein once secure, the shower curtain extender device and attached shower curtain is hung on a shower rod, which allows the shower curtain to be lengthened approximately 8-9 inches;

wherein the body component is a plastic body component configured to extend the shower curtain during use and prevents water from escaping the shower and bath area;

wherein the valence topper component comprises a wide pocket configured to accommodate a tension rod and an elongated flap;

wherein the body component is a variable thickness body; and further wherein the valance topper is secured in front of the body component to conceal the body component from view.

12. The shower curtain extender device of claim 11 further comprising a second row of buttons, which are positioned 1-2 inches above a bottom row of buttons.

13. The shower curtain extender device of claim 11, wherein the shower curtain extender device is available in several colors, lengths, and styles, corresponding with existing bathroom décor.

* * * * *